US005608283A

United States Patent [19]

Twichell et al.

[11] Patent Number: 5,608,283

[45] Date of Patent: Mar. 4, 1997

[54] ELECTRON-EMITTING DEVICES UTILIZING ELECTRON-EMISSIVE PARTICLES WHICH TYPICALLY CONTAIN CARBON

[75] Inventors: Jonathan C. Twichell, Acton, Mass.; George R. Brandes, Danbury, Conn.; Michael W. Geis, Acton, Mass.; John M. Macaulay, Palo Alto, Calif.; Robert M. Duboc, Jr., Menlo Park, Calif.; Christopher J. Curtin, Los Altos Hills, Calif.

[73] Assignee: Candescent Technologies Corporation, San Jose, Calif.

[21] Appl. No.: 269,283

[22] Filed: Jun. 29, 1994

[51] Int. Cl.[6] ..... H01J 1/30

[52] U.S. Cl. ..... 313/309; 313/310; 313/351; 445/51

[58] Field of Search ..... 313/309, 310, 313/336, 351; 427/77; 445/24, 50, 51

[56] References Cited

U.S. PATENT DOCUMENTS

| | | | |
|---|---|---|---|
| 3,731,131 | 5/1973 | Kupsky . | |
| 3,998,678 | 12/1976 | Fukase et al. . | |
| 4,193,013 | 3/1980 | Futamoto et al. | 313/336 |
| 4,345,181 | 8/1982 | Shelton . | |
| 4,498,952 | 2/1985 | Christensen | 313/309 |
| 4,551,649 | 11/1985 | Olson | 313/336 |
| 4,683,399 | 7/1987 | Soclof | 313/309 |
| 5,019,003 | 5/1991 | Chason . | |
| 5,129,850 | 7/1992 | Kane et al. . | |
| 5,138,220 | 8/1992 | Kirkpatrick | 313/309 |
| 5,141,460 | 8/1992 | Jaskie et al. . | |
| 5,180,951 | 1/1993 | Dworsky et al. . | |
| 5,190,796 | 3/1993 | Iacovangelo . | |
| 5,199,918 | 4/1993 | Kumar . | |
| 5,202,571 | 4/1993 | Hirabayashi et al. . | |
| 5,227,699 | 7/1993 | Busta | 313/309 |
| 5,249,340 | 10/1993 | Kane et al. | 29/25.02 |
| 5,252,833 | 10/1993 | Kane et al. . | |
| 5,278,475 | 1/1994 | Jaskie et al. . | |
| 5,371,431 | 12/1994 | Jones et al. | 313/336 |
| 5,449,970 | 9/1995 | Kumar et al. | 313/309 |
| 5,451,830 | 9/1995 | Huang | 313/309 |

FOREIGN PATENT DOCUMENTS

| | | | |
|---|---|---|---|
| 0528391 | 2/1993 | European Pat. Off. | H01J 9/02 |
| 0555074A1 | 8/1993 | European Pat. Off. | H01J 1/30 |
| 0572777A1 | 12/1993 | European Pat. Off. | H01J 31/12 |
| 54-51473 | 4/1979 | Japan | 313/336 |
| 2260641A | 4/1993 | United Kingdom | H01J 1/30 |
| WO91/05361 | 4/1991 | WIPO | H01J 9/02 |
| WO91/19023 | 12/1991 | WIPO . | |

OTHER PUBLICATIONS

First International Workshop On Plasma–Based ION Implantation, vol. 12, No. 2, ISSN 0734–211X, Journal of Vacuum Science & Technology B (Microelectronics and Nanometer Structures), Mar.–Apr. 1994, USA, pp. 717–721, Liu J. et al., "Modification of Si Field Emitter Surfaces By Chemical Conversion To SiC".

Chakarvarti et al, "Morphology of etched pores and microstructures fabricated from nuclear track filters," *Nuclear Insts. & Meths. in Physics Research,* 1991, pp. 102–115.

(List continued on next page.)

*Primary Examiner*—Sandra L. O'Shea
*Assistant Examiner*—Matthew J. Esserman
*Attorney, Agent, or Firm*—Skjerven Morrill, MacPherson, Franklin & Friel LLP; Ronald J. Meetin

[57] ABSTRACT

In one electron-emitting device, non-insulating particle bonding material (24) securely bonds electron-emissive carbon-containing particles (22) to an underlying non-insulating region (12). The carbon in each carbon-containing particle is in the form of diamond, graphite, amorphous carbon, or/and silicon carbide. In another electron-emitting device, electron-emissive pillars (22/28) overlie a non-insulating region (12). Each pillar is formed with an electron-emissive particle (22) and an underlying non-insulating pedestal (28).

35 Claims, 5 Drawing Sheets

OTHER PUBLICATIONS

Chakarvarti et al, "Microfabrication of metal–semiconductor heterostructures and tubules using nuclear track filters," *J. Micromec. Microeng.*, 1993, pp. 57–59.

Spohr, *Ion Tracks and Microtechnology, Principles and Applications,* ed. K. Bethge, 1990, pp. 246–255.

Busta, "Vacuum microelectronics"—1992, *J. Micromech. Microeng.*, 1992 pp. 43–74.

Fischer, "Production and use of nuclear tracks: imprinting structure on solids," *Reviews of Modern Phys.*, Oct. 1993, pp. 907–948.

ELECTRON-EMITTING DEVICES UTILIZING ELECTRON-EMISSIVE PARTICLES WHICH TYPICALLY CONTAIN CARBON

GOVERNMENT SUPPORT

This invention was made with government support under Contract Number F19628-90-C-0002 awarded by the Air Force. The government has certain rights in the invention.

FIELD OF USE

This invention relates to electron emission. More particularly, this invention relates to structures and manufacturing techniques for electron-emitting devices, commonly referred to as cathodes, suitable for products such as cathode-ray tube ("CRT") displays of the flat-panel type.

BACKGROUND ART

Cathodes can emit electrons by photoemission, thermionic emission, and field emission, or as the result of negative electron affinity. A field-emission cathode (or field emitter) provides electrons when subjected to an electric field of sufficient strength. The electric field is created by applying a suitable voltage between the cathode and an electrode, typically referred to as the anode or gate electrode, situated a short distance away from the cathode.

Various techniques have been explored for creating field emitters. Chason, U.S. Pat. No. 5,019,003, fabricates a field emitter by depositing preformed electron-emissive objects on a substrate consisting of dielectric and/or electrically conductive material. The preformed objects, which have sharp edges, can consist entirely of electron-emissive material such as molybdenum or titanium carbide. Alternatively, the preformed objects can consist of electrically insulating cores with thin electron-emissive coatings over the insulating cores. The longest dimension of the objects is approximately 1 μm. A bonding layer is employed to bond the objects to the substrate.

Jaskie et al ("Jaskie I"), U.S. Pat. No. 5,141,460, discloses a technique in which diamond is used in fabricating a field emitter. Kane et al ("Kane I"), U.S. Pat. No. 5,129,850, discloses a related technique for manufacturing a field emitter that utilizes diamond. The fabrication techniques in Jaskie I and Kane I generally entail implanting carbon into a substrate to create diamond nucleation sites and then growing diamond crystallites at the diamond nucleation sites. The resulting regions of diamond crystallites appear to be electron emissive.

Use of diamond to provide electrons is desirable for a number of reasons. Depending on how it is produced, diamond can have a low work function. This is advantageous because the electric field needed to emit electrons decreases as the work function decreases. Diamond has a low chemical reactivity. In particular, the gases typically present in a sealed vacuum device such as a CRT have little effect on diamond. Also, changes in temperature affect diamond less than most materials used as electron emitters.

In Jaskie I and Kane I, the diamond crystallites are grown by chemical vapor deposition ("CVD"). While CVD is economically suitable for depositing many materials, diamond CVD is costly because the diamond CVD growth rate is low and a high CVD temperature is needed. The diamond CVD in Jaskie I and Kane I appears too expensive for low-cost volume production of CRTs in flat-panel televisions.

Jaskie et al ("Jaskie II"), U.S. Pat. No. 5,278,475, produces a gated field emitter that utilizes diamond crystallites as electron sources. The diamond crystallites are deposited across the upper surface of a supporting structure consisting of a substrate or a patterned layer of conductive/semiconductive material formed on an electrically insulating substrate. A dielectric layer is deposited over the diamond crystallites. A gate (or control) electrode layer, likewise consisting of conductive/semiconductive material, is deposited on the dielectric layer. Openings are formed through the gate electrode and dielectric layer to expose diamond crystallites at selected areas of the supporting structure.

Kane et al ("Kane II"), U.S. Pat. No. 5,252,833, discloses a similar gated field emitter in which diamond crystallites provide electrons. The diamond crystallites in Kane II are situated on conductive/semiconductive paths at the bottoms of openings through a dielectric layer and an overlying gate electrode. The diamond crystallites consist of polycrystalline diamond. Taking note of the fact that the (positive) affinity of a material to retain electrons increases the surface work function and thus increases the electric field needed for an electron to escape the material, Kane II indicates that polycrystalline diamond with a (111) crystallographic orientation is particularly useful as an electron source because (111) polycrystalline diamond has a negative electron affinity.

Electron affinity is an important consideration in choosing an electron source. However, maintaining a negative electron affinity during volume field-emitter production requires special steps. Also, it is not clear that the diamond crystallites in Jaskie II and Kane II will be securely fixed to the underlying material in a manner that permits a control voltage to be suitably impressed on the diamond crystallites. As a result, the gated field emitters of Jaskie II and Kane II may not perform well. It would be advantageous to have an electron-emitting device in which diamond or a related carbon-containing material can be utilized as an electron source and which can be fabricated in a manner that avoids the above-mentioned disadvantages of the prior art.

GENERAL DISCLOSURE OF THE INVENTION

The present invention furnishes simple, reliable electron-emitting devices in which electrons are emitted from particles that typically contain carbon in a form such as diamond. The electron emitters of the invention are suitable for use in CRTs of products such as flat-panel televisions and other flat-panel displays. Each of the electron emitters is fabricated according to a simple manufacturing process which typically avoids expensive fabrication steps such as diamond CVD. The invention also provides effective physical and electrical connection between the electron-emissive particles and the underlying material. Consequently, the invention attains the advantages of the prior art but avoids its disadvantages.

Specifically, in one electron-emitting device configured according to the invention, a multiplicity of laterally separated electron-emissive carbon-containing particles are distributed over, and electrically coupled to, a lower electrically non-insulating region. As discussed further below, "electrically non-insulating" means electrically conductive or electrically resistive. Electrically non-insulating particle bonding material securely bonds the carbon-containing particles to the lower non-insulating region. The bonding material ensures that good electrical coupling occurs between the lower non-insulating region and the particles. Suitable control voltages thereby can be readily impressed on the particles by way of the lower non-insulating region so as to achieve good emitter performance.

The carbon in the carbon-containing particles is typically in the form of electrically non-insulating diamond. The particles may alternatively or additionally contain carbon in the form of graphite, amorphous carbon, or/and electrically non-insulating silicon carbide. Each particle is preferably at least 50 atomic percent carbon.

A structural layer typically lies over the carbon-containing particles. An opening extends through the structural layer to expose the particles. When the structural layer is formed with a dielectric layer and an overlying gate layer, the resulting structure is a gated electron emitter.

As noted above, diamond can be a good electron source. However, in fabricating a diamond-based field emitter, special steps often need to be employed in order to take advantage of diamond's good characteristics. Exercising the requisite care can be a significant burden during volume production of field emitters. Carbon forms such as graphite, amorphous carbon, and silicon carbide, while perhaps not appearing to have field-emission properties as good as those of diamond, can be excellent electron sources in production-scale fabrication of electron emitters. Even when the electron emitters of the invention utilize diamond, electrons may be emitted primarily from non-diamond carbon forms, particularly graphite.

In another electron-emitting device configured according to the invention, a multiplicity of laterally separated electron-emissive pillars are situated over a lower electrically non-insulating region. Each pillar is formed with an electrically non-insulating pedestal and an overlying electron-emissive particle. The pedestal is electrically coupled to the lower non-insulating region. The side surface of the pedestal extends generally vertically or, in going downward, slopes inward along at least part of the pedestal's height.

Each electron-emissive particle in the pillared structure typically contains carbon, again preferably at least 50 atomic percent, in the form of electrically non-insulating diamond, graphite, amorphous carbon, or/and electrically non-insulating silicon carbide. A structural layer preferably lies on the lower non-insulating region in the pillared structure. The structural layer is typically formed with a dielectric layer and an overlying electrically non-insulating gate layer. The pillars are located in an open space that extends through the structural layer down to the lower non-insulating region.

When the particles emit electrons by field emission, the pillared structure is particularly advantageous because situating the electron-emissive particles at the tops of pillars results in an increase in the local electric field to which the particles are subjected. As a consequence, the electron-emission current density is increased.

One process for manufacturing an electron-emitting device according to the invention entails dispersing a multiplicity of carbon-containing particles over a lower electrically non-insulating region of a supporting structure. Electrically non-insulating particle bonding material is provided to bond the particles to the lower non-insulating region. The bonding operation can be performed after, or partly before, the particle-dispersion step. In a typical case, the bonding operation entails heating the structure to form electrically non-insulating carbide or metal-carbon alloy between the particles and the non-insulating region.

In another process for manufacturing an electron-emitting device according to the invention, a multiplicity of electron-emissive particles are distributed over a lower electrically non-insulating region in such a way that the particles are securely fixed to the non-insulating region. Using the electron-emissive particles as masks to protect underlying material of the non-insulating region, part of the non-insulating region is removed to form electron-emissive pillars. Each pillar consists of an electron-emissive particle and an underlying electrically non-insulating pedestal created from part of the non-insulating region.

In a further process for manufacturing an electron-emitting device according to the invention, a multiplicity of electron-emissive particles are provided with coatings of a material such as a polymer. The coated particles are then distributed over a lower electrically non-insulating region of a supporting structure in such a manner that the electron-emissive (core) particles are electrically coupled to, and securely fixed in location relative to, the non-insulating region. The distributing step normally entails altering the particle coatings in order to expose the electron-emissive particles.

The fabrication processes of the invention typically do not require complex processing steps. By distributing the electron-emissive particles across the lower non-insulating region in a preformed state, there is no need to perform expensive processing steps such as diamond CVD. Also, use of preformed particles enables the particle size to be made more uniform than is typically feasible with CVD. Accordingly, the electron-emission current density across the emitting area can be made more uniform.

Diamond, graphite, amorphous carbon, and silicon carbide all have low chemical reactivity. When the electron-emissive particles consist of one or more of these materials, the low chemical reactivity provides wide latitude in processing temperature, in choice of other materials to be used in the electron-emitting device, and in choice of fabrication equipment and chemical environment. The net result is a significant advance over the prior art.

BRIEF DESCRIPTION OF THE DRAWINGS

FIGS. 4*a*, 4*b*1, 4*b*2, 4*c*, and 4*d* are cross-sectional front views representing steps in part of an inventive process for fabricating the electron-emitting structure of FIG. 1.

Like reference symbols are employed in the drawings and in the description of the preferred embodiments to represent the same or very similar item or items.

DESCRIPTION OF THE PREFERRED EMBODIMENTS

The following definitions are used in the description below. The "mean diameter" for a two-dimensional item of non-circular shape is the diameter of a circle of the same area as the non-circular item. The "mean diameter" for a three-dimensional item of non-spherical shape either is the diameter of a sphere of the same volume as the non-spherical item or is the diameter of a right circular cylinder of the same volume and height as the item. The equal-volume cylinder diameter is generally utilized when the item is cylindrical or considerably elongated.

Herein, the term "electrically insulating" (or "dielectric") generally applies to materials having a resistivity greater than $10^{10}$ ohm-cm. The term "electrically non-insulating" thus refers to materials having a resistivity below $10^{10}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{10}$ ohm-cm. These categories are determined at an electric field of no more than 1 volt/μm.

Examples of electrically conductive materials (or electrical conductors) are metals, metal-semiconductor compounds (such as metal silicides), and metal-semiconductor eutectics (such as gold-germanium). Electrically conductive materials also include semiconductors doped (n-type or p-type) to a moderate or high level. Electrically resistive materials include intrinsic and lightly doped (n-type or p-type) semiconductors. Further examples of electrically resistive materials are cermet (ceramic with embedded metal particles), other such metal-insulator composites, graphite, amorphous carbon, and modified (e.g., doped or laser-modified) diamond.

Figure 1:
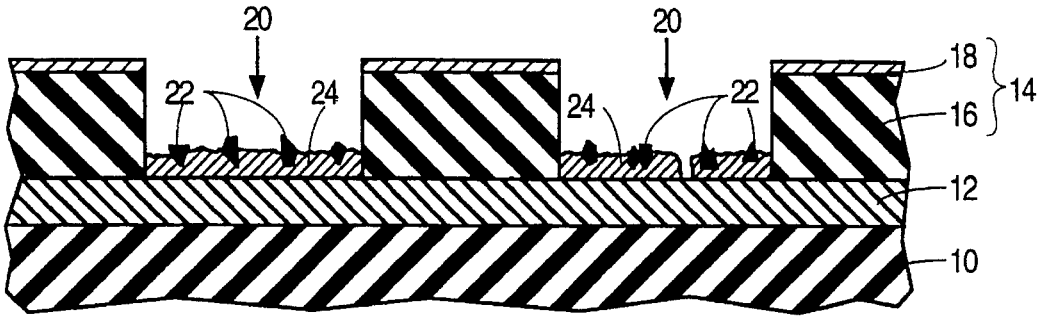
FIGS. 1 and 2 are cross-sectional front views of electron-emitting structures according to the invention.

Referring to FIG. 1, it illustrates a portion of large-area gated electron-emitting device configured according to the teachings of the invention. This electron-emitting device is typically employed to excite phosphors on a faceplate (not shown) in a CRT of a flat-panel display such as a flat-panel television or a flat-panel video monitor suitable for a personal computer, a lap-top computer, or a work station.

The area emitter in FIG. 1 contains an electrically insulating substrate 10 consisting of ceramic or glass. Insulating substrate 10 is typically a plate having a largely flat upper surface and a largely flat lower surface (not shown) substantially parallel to the upper surface. In a flat panel CRT display, substrate 10 constitutes at least part of the backplate (or baseplate).

Substrate 10 furnishes support for the electron-emitting device. As such, the substrate thickness is at least 500 μm. In a 25-cm (diagonal) flat-panel display where internal supports (not shown) are placed between the phosphor-coated faceplate and the electron emitter, the substrate thickness is 1–2 mm. If substrate 10 provides substantially the sole support for the electron emitter, the substrate thickness is 4–14 mm.

An emitter (or base) electrode consisting of a lower electrically non-insulating region 12 lies along the top of substrate 10. Lower non-insulating region 12, which is typically a patterned electrically conductive layer of approximately constant thickness, has a substantially flat upper surface. Non-insulating region 12 is preferably formed with a metal such as chromium. In this case, the thickness of region 12 is 0.05–1.5 μm. Other metals that can be used to form region 12 are nickel, titanium, cobalt, molybdenum, and iron as well as combinations of these metals. Region 12 can also consist of gold-germanium, silicon, electrically non-insulating carbon, or/and electrically non-insulating silicon carbide.

A patterned structural layer 14 lies along the top of lower non-insulating region 12. Structural layer 14 normally consists of two or more sub-layers. In the embodiment shown in FIG. 1, layer 14 is formed with a dielectric layer 16 and an overlying electrically non-insulating gate layer 18.

Dielectric layer 16 typically consists of silicon oxide (CVD or sputtered). Silicon nitride (CVD or sputtered) can alternatively be used to form layer 16. Layer 16 can also be created from combinations of silicon oxide, silicon nitride, and/or other dielectrics. Layer 16 has a thickness of 0.3–2 μm, typically 1 μm.

Gate layer 18 preferably consists of an electrical conductor, typically tungsten, nickel, molybdenum, or/and aluminum. The thickness of layer 18 is 30–300 nm, typically 200 nm.

A group of laterally separated open spaces 20 extend through structural layer 14 down to corresponding portions of the upper surface of lower non-insulating region 12. Each opening 20 is normally in the shape of a circle or square as viewed in a direction perpendicular to the upper surface of region 12. The mean diameter of each open space 20 is 0.5–5 μm, typically 3 μm. The average center-to-center distance of open spaces 20 is typically twice their mean diameter when the diameter is 0.5–2 μm, and somewhat less when the diameter is greater than 2 μm.

A multiplicity of laterally separated electron-emissive carbon-containing particles 22 are distributed across the upper surface portions of non-insulating region 12 at the bottoms of open spaces 20. The carbon in particles 22 is in the form of electrically non-insulating diamond, graphite, amorphous carbon, or/and electrically non-insulating silicon carbide. Each particle 22 consists of at least 50 atomic percent carbon. The carbon percentage, at least along the outer particle surfaces, is typically close to 100 atomic percent when the carbon is diamond, graphite, or/and amorphous carbon. Particles 22 can be of regular shape or, as illustrated in FIG. 1, of irregular shape. The average mean diameter of particles 22 is 5 nm–1 μm, typically 100 nm.

Diamond, especially when it has negative electron affinity, is often the preferred type of carbon for particles 22. However, in fabricating a field emitter, special steps typically must be taken to maintain the emissive properties of diamond at their good levels. In fact, during field-emitter fabrication, diamond particles may be partially converted to other forms of carbon. Electron emission may occur primarily from regions of one of these other carbon forms, typically graphite.

Particles 22 are situated at locations substantially random relative to one another in each of open spaces 20. The average center-to-center spacing of particles 22 ranges from essentially zero (i.e., nearly abutting) to approximately 0.5 μm and typically is 0.3 μm. In fact, two or more of the carbon-containing particles occasionally touch one another as, for example, indicated in right-hand open space 20 in FIG. 1. In this case, the two touching particles effectively constitute a single particle 22.

Carbon-containing particles 22 are securely fixed to lower non-insulating region 12 by way of electrically non-insulating particle bonding material 24 that extends from particles 22 down to region 12. Particle bonding material 24 normally extends at least partway under particles 22. Bonding material 24 may also extend partly over part or all of particles 22. FIG. 1 illustrates an example in which material 24 extends partly over part of particles 22.

Within each open space 20, bonding material 24 typically forms a continuous layer except where particles 22 penetrate through material 24 to contact region 12. Nonetheless, material 24 may have perforations or be divided into two or more portions within each open space 20 as shown for right-hand open space 20 in FIG. 1.

Bonding material 24 may consist of various electrical conductors. Typically, material 24 includes metallic carbide or a metal-carbon alloy. When lower region 12 consists of metal along its upper surface, part of material 24 is often formed with a carbide of that metal. Material 24 may include a carbide of titanium even if region 12 does not contain titanium. An alloy of nickel with carbon can alternatively or additionally be utilized to form material 24. Material 24 can also be formed with molybdenum or with a metal-semiconductor eutectic, such as gold-germanium or/and titanium-gold-germanium, part of which may be in carbide form.

Carbon-containing particles 22 are electrically connected to the upper surface of non-insulating region 12 either directly or by way of bonding material 24. When particles 22 are subjected to an applied gate-to-cathode parallel-plate electric field of 20 volts/μm under vacuum conditions (typically $10^{-7}$ torr or less), particles 22 produce an electron current density of at least 0.1 mA/cm$^2$ as measured at the phosphor-coated faceplate of the flat-panel display. This defines a threshold level for the electron emissivity of particles 22 here, especially when the electron-emitting device is employed in a CRT of a flat-panel display.

Figure 2:
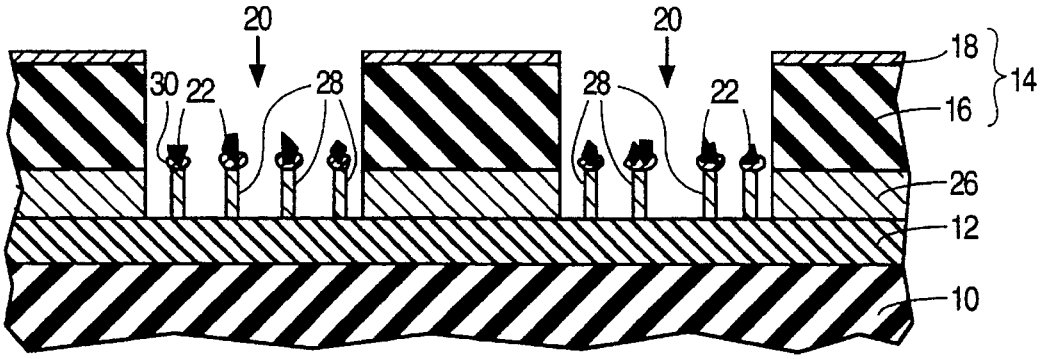

FIG. 2 illustrates a portion of another large-area gated electron-emitting device configured in accordance with the invention. As with the area emitter in FIG. 1, the area emitter in FIG. 2 is suitable for use in flat-panel CRT displays. The electron-emitting structure in FIG. 2 contains insulating substrate 10, non-insulating region 12, and structural layer 14 all arranged as in FIG. 1 with open spaces 20 extending through layer 14 down to the flat upper surface of region 12. Structural layer 14 again contains dielectric layer 16 and gate layer 18.

In addition, structural layer 14 includes a further electrically non-insulating layer 26 situated between non-insulating region 12 and dielectric layer 16. Further non-insulating layer 26 is typically an electrical conductor. Layer 26 may be formed with the same material as, or a different material from, non-insulating region 12. The thickness of layer 26 is 0.1–2 μm, typically 0.5 μm.

A multiplicity of laterally separated electron-emissive pillars are distributed over the upper surface portions of non-insulating region 12 along the bottoms of open spaces 20 in FIG. 2. The density of the electron-emissive pillars within open spaces 20 varies from a minimum of 3–4 per open space 20 to nearly abutting. Each electron-emissive pillar consists of an electron-emissive particle 22 and an underlying electrically non-insulating pedestal 28 that contacts region 12. Electron-emissive particles 22 preferably are carbon-containing particles having the characteristics described above in connection with the electron-emitting structure of FIG. 1.

The side (or lateral) surface of each non-insulating pedestal 28 extends vertically—i.e., perpendicular to the upper surface of non-insulating region 12—or slopes inward in going from the top of pedestal 28 downward towards region 12. The size and shape of the top surface of each pedestal 28 is approximately the same as the area shadowed by overlying electron-emissive particle 22 in the vertical direction. As a result, the mean top diameter of each pedestal 28 is approximately the same as the mean lateral diameter of overlying particle 22.

The height of non-insulating pedestals 28 is usually approximately equal to the thickness of further non-insulating layer 26. In particular, pedestals 28 have an average height of 0.1–2 μm, typically 0.5 μm. The ratio of the height of each pedestal 28 to its mean diameter is 1–20, typically 5.

Pedestals 28 can be formed with a variety of electrical conductors, specifically metals such as chromium, nickel, titanium, molybdenum, and iron. Pedestals 28 may also consist of gold-germanium or silicon, either conductively doped or electrically resistive. Forming pedestals 28 from electrically resistive material can improve emission uniformity. Portions 30 of electrically non-insulating particle bonding material fixedly secure carbon-containing particles 22 to underlying pedestals 28. Bonding material portions 30 typically consist of metal carbide such as a carbide of the metal used to form pedestals 28, but can include other electrical conductors.

Figure 3:
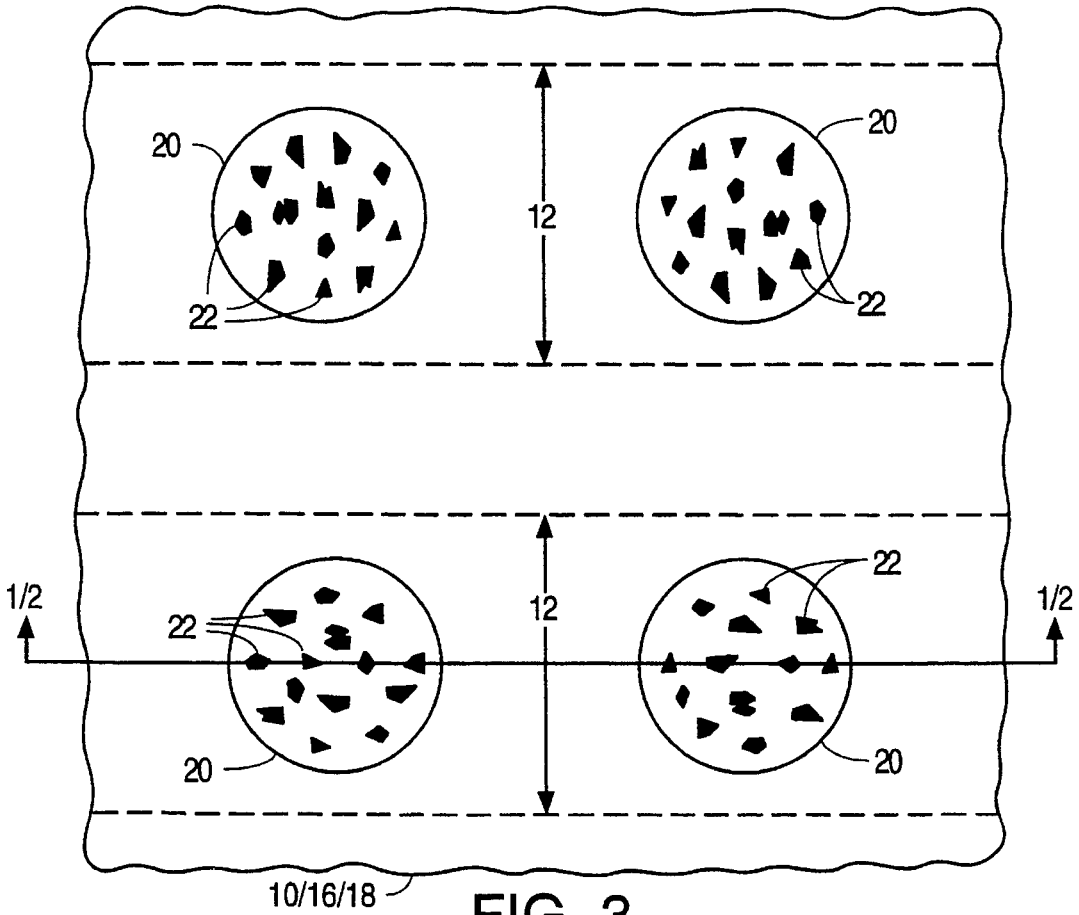
FIG. 3 is a plan view of the electron-emitting structure in each of FIGS. 1 and 2. The cross section of each of FIGS. 1 and 2 is taken through plane ½—½ in FIG. 3.

Turning to FIG. 3, it depicts the basic nature of the layout for an electron-emitting device having the cross section of FIG. 1 or 2. FIG. 3 does not show particle bonding material 24 or 30. In illustrating the layout of the electron emitter of FIG. 2, pedestals 28 do not appear in FIG. 3 because they are fully covered (or shadowed) by electron-emissive particles 22.

As shown in FIG. 3, lower non-insulating region 12 is patterned into a group of parallel lines laterally separated from each other. The width of each (emitter) line 12 is typically 100 μm. Open spaces 20 may be distributed in a regular or random pattern over lines 12. Although lines 12 are illustrated as being only slightly wider than open spaces 20 in FIG. 3, lines 12 are typically 1–2 orders of magnitude wider than open spaces 20. Gate layer 18 is typically patterned into a group of parallel gate lines (not shown) extending perpendicular to lines 12.

Lower non-insulating region 12 in the embodiments of FIGS. 1–3 can be formed with an electrically resistive layer situated over an electrically conductive layer. Each of the lines that typically constitute region 12 consists of segments from both the resistive layer and the conductive layer. The resistive layer is typically formed with cermet or/and lightly doped polycrystalline silicon.

Figures 4A, 4C, 4D:
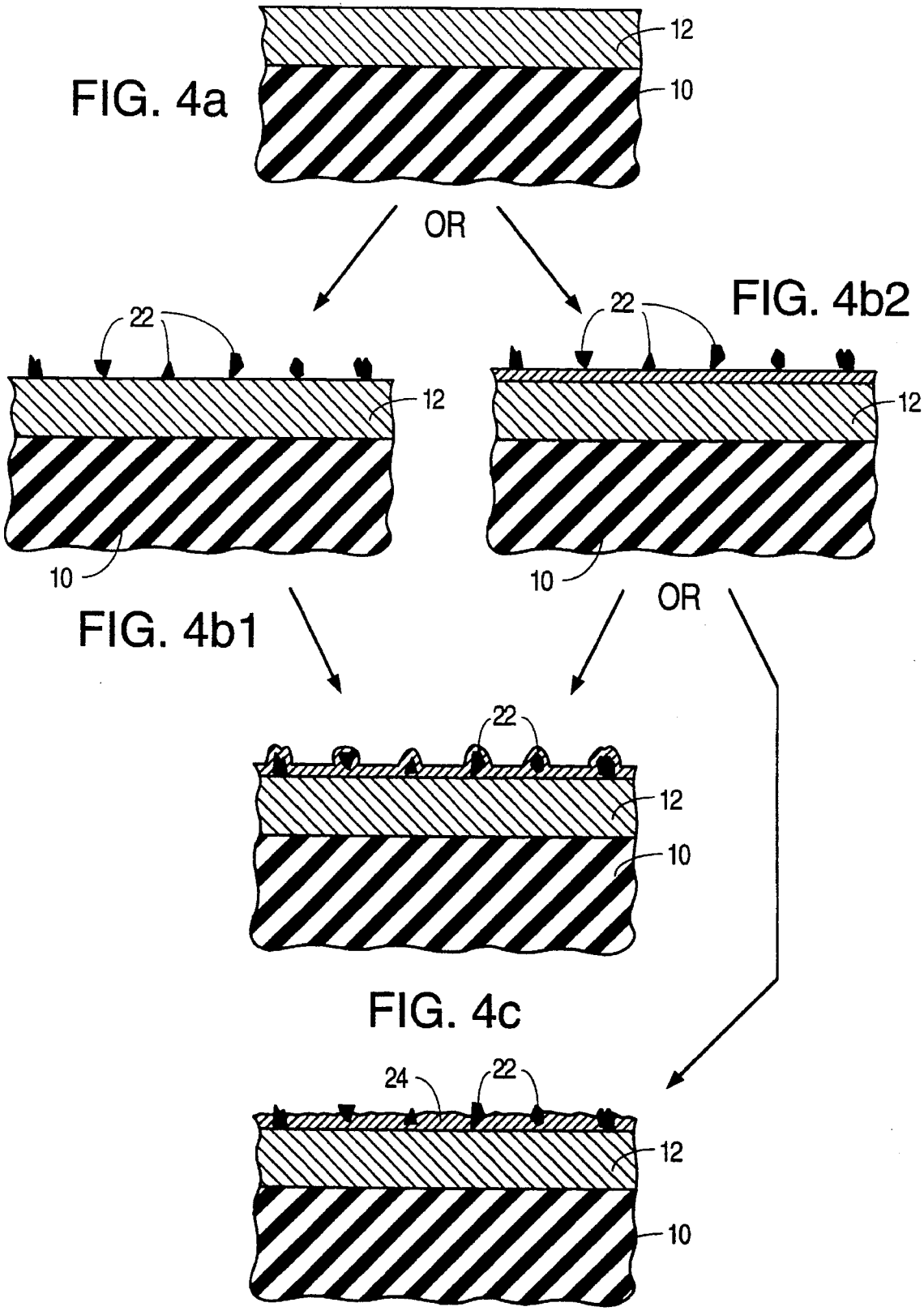

FIGS. **4*a*–4*d* (collectively "FIG. 4") illustrate several variations of a process for manufacturing part of the electron-emitting structure of FIG. 1. In all of the illustrated variations, patterned non-insulating region 12 is first formed on insulating substrate 10 as indicated in FIG. 4*a*. This typically entails creating a blanket layer of a suitable electrical conductor on substrate 10** and removing the undesired portions of the blanket conductive layer according to an etching technique using a suitable photoresist mask.

Carbon-containing particles 22 are then distributed in a relatively uniform manner across the upper surface of non-insulating region 12 in such a way that particles 22 are securely fixed to, and electrically coupled to, region 12. The distributing step can be performed according to any of three process variations (or sequences) variously shown in FIGS. **4*b*1, 4*b*2, 4*c*, and 4*d*. FIG. 4*b*1 illustrates the next part of the process flow in one of the variations. FIG. 4*b*2** depicts the next part of the process flow for the other two variations.

In the process variations represented by FIG. **4*b*1, preformed electron-emissive carbon-containing particles 22 are dispersed in a relatively uniform manner across the top of lower region 12. Particles 22 may contain graphite or/and amorphous carbon, both of whose electron emissivities in the natural states are normally sufficient for the present invention. Particles 22** may also be created with diamond or/and silicon carbide. Some forms of diamond and silicon carbide have electron emissivities in the natural states due typically to the presence of nitrogen, while other forms of diamond and silicon carbide have substantially no natural electron emissivity. If reliance is placed on diamond or/and silicon carbide for electron emission, an earlier step is normally performed to enhance the electron emissivity.

Carbon-containing particles 22 preferably consist of diamond grit (nearly 100 atomic percent $sp^3$ carbon) that has previously been made sufficiently electron emissive by suitably doping the diamond grit or slightly altering its crystalline structure. When doping is used to make the diamond grit electron emissive, the doping can be performed with boron, phosphorus, arsenic, lithium, sodium, nitrogen, or sulphur. The crystalline structure of the diamond grit can be altered to make it electron emissive by ion implanting carbon into the grit or by subjecting it to a laser to create nanometer-scale regions of electrically non-insulating carbon. Doping and crystalline-structure alteration techniques by ion implantation can also be utilized to modify particles 22 when they are created from silicon carbide.

One technique for dispersing particles 22 uniformly across non-insulating region 12 entails first imparting negative charges to a number of carbon-containing particles. When diamond grit is used, the grit is negatively charged by exposing it to a fluorine-containing plasma, thereby enhancing the propensity of the grit to become negatively charged. The diamond is then negatively charged according to a conventional technique.

The negatively charged carbon-containing particles are subsequently deposited on the upper surface of an organic solvent. Alcohol is used as the solvent in the diamond-grit case. While some of the carbon-containing particles sink into the solvent, many of the smaller ones remain on the upper surface of the solvent. The negative charges on the particles situated along the upper solvent surface cause those particles to be dispersed in a largely uniform manner across the solvent surface.

The structure formed with components 10 and 12 is dipped into the organic solvent. As the structure is taken out of the solvent, some of the carbon-containing particles—largely those along the solvent surface—adhere to the top of non-insulating region 12. Due to the negative charging, the distribution of resulting adherent particles 22 is largely uniform across region 12. FIG. **4*b*1** shows the resulting structure.

A spraying technique can be employed to obtain a substantially uniform distribution of particles 22 across the upper surface of region 12. Particles 22 and an appropriate solvent are loaded into a suitable spraying apparatus. The solvent is typically hexane or isopropanol when particles 22 are diamond grit. The resulting solution is then sprayed across the top of region 12. The solvent present on the structure is later removed either by an active drying step (e.g., heating) or simply by letting the solvent evaporate, thereby leaving particles 22 on region 12. Alternatively, electrophoretic deposition can be used to disperse particles 22 across the top of region 12. In either case, the resultant structure appears basically as shown in FIG. **4*b*1**.

Next, electrically non-insulating particle bonding material 24 is provided along the upper structural surface in such a manner as to extend partly over and at least partly under carbon-containing particles 22. FIG. **4*c* shows the resultant structure. Bonding material 24 can be so created by performing a chemical or physical vapor deposition of suitable electrically non-insulating material. For example, physical vapor deposition of titanium can be done. CVD of graphite can be performed. Alternatively, a heating step can be done to form material 24 as electrically non-insulating carbide between region 12 and particles 22. Deposition of electrically non-insulating material can also be combined with a heating step to form at least part of material 24** as non-insulating carbide.

An operation is performed to expose the tops of carbon-containing particles 22 as shown in FIG. **4*d*. For example, the structure can be subjected to a suitable solvent vapor to dissolve portions of material 24 covering the tops of particles 22. Alternatively, an etch can be done. The structure of FIG. 4*d* serves as part of the electron emitter in FIG. 1**.

Turning back to FIG. **4*b*2 for the remaining two process variations, an intermediate electrically non-insulating layer 32 is formed along the upper surface of non-insulating region 12. Non-insulating layer 32 may be created by depositing a metal such as titanium, nickel, or molybdenum on region 12 using a physical deposition technique such as sputtering or evaporation. A metal-semiconductor eutectic, such as gold-germanium titanium-gold-germanium, can also be evaporated on region 12 to create layer 32**.

Preformed electron-emissive carbon-containing particles 22 are then dispersed in a relatively uniform manner across non-insulating layer 32 as shown in FIG. **4*b*2. Particles 22 preferably consist of diamond grit that has previously been made electron emissive according to one of the above-mentioned techniques. Similarly, one of the techniques used to disperse particles 22 across lower region 12 in the process variations illustrated by FIG. 4*b*1 is used here to disperse particles 22 in a relatively uniform, but substantially random, manner across layer 32**.

Non-insulating layer 32 can be heated or/and otherwise treated to convert it into the form of non-insulating bonding material 24 shown in FIG. **4*c*. Portions of material 24 again cover carbon-containing particles 22 along their top surfaces and at least partially along their bottom surfaces so that particles 22 are securely fixed to non-insulating region 12. Conversion of layer 32 into bonding material 24 of FIG. 4*c* may involve depositing another electrically non-insulating layer on top of the structure. The tops of particles 22 are subsequently exposed in the manner described above to produce the final electron-emissive structure of FIG. 4*d***.

Alternatively, non-insulating layer 32 in the structure of FIG. **4*b*2 can be heated or/and otherwise treated to convert it directly into the form of bonding material 24 shown in FIG. 4*d*—i.e. without going through the intermediate stage of FIG. 4*c*. The structure of FIG. 4*d* is then used in the electron emitter of FIG. 1**.

When heating is employed to convert non-insulating layer 32 into bonding material 24, part or all of layer 32 may become carbide or a metal-carbon alloy. For example, if layer 32 consists of titanium, the structure can be heated at 900° C. for 60 minutes to form titanium carbide between particles 22 and region 12. If layer 32 is formed with nickel, the same temperature/time procedure can be used to convert the nickel into an alloy of carbon with nickel. The heating step can be done at 400° C. for approximately 10 minutes if layer 32 consists of titanium-gold-germanium. Carbide may again form between region 12 and particles 22. These steps produce either the structure of FIG. **4*c* or that of FIG. 4*d***.

Figure 5A:
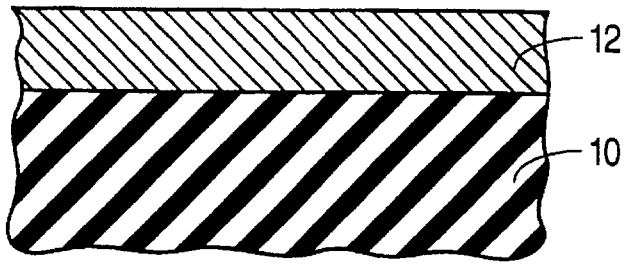
FIGS. 5*a*, 5*b*, and 5*c* are cross-sectional front views representing steps in part of an alternative inventive process for fabricating the electron-emitting structure of FIG. 1.

FIGS. **5*a*, 5*b*, and 5*c* (collectively "FIG. 5") illustrate another process for fabricating part of the electron-emitting device of FIG. 1. The starting point is again insulating substrate 10 on which patterned lower non-insulating region 12 is formed as shown in FIG. 5*a*. Region 12 can be provided on substrate 10 by a deposition/masked-etch procedure as described above for the process of FIG. 4**.

A batch of electron-emissive carbon-containing particles are provided with roughly conformal coatings typically consisting of a polymer. The coatings are created in such a way that the mean outside diameter of the coated particles is quite uniform from particle to particle. The carbon-containing particles preferably consist of diamond grit.

Figure 5B:
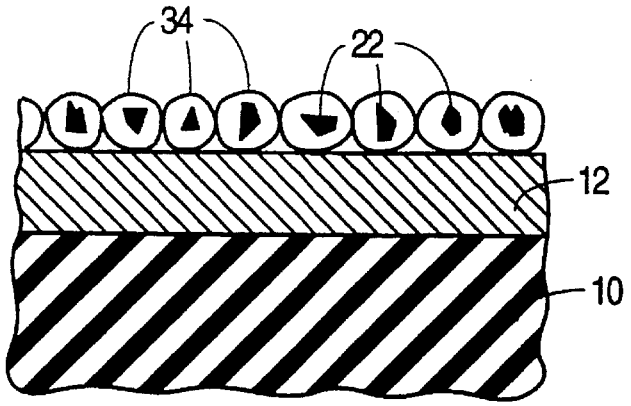

A monolayer of the coated carbon-containing particles is formed over the upper surface of non-insulating region 12 as shown in FIG. 5*b*. Items 22 in FIG. 5*b* are the electron-emissive carbon-containing particles, while items 34 are the particle coatings. Because coated particles 22/34 are in a monolayer, particles 22 are distributed uniformly across region 12. Coated particles 22/34 have an average center-to-center spacing of up to 0.5 μm, typically 0.3 μm.

Figure 5C:
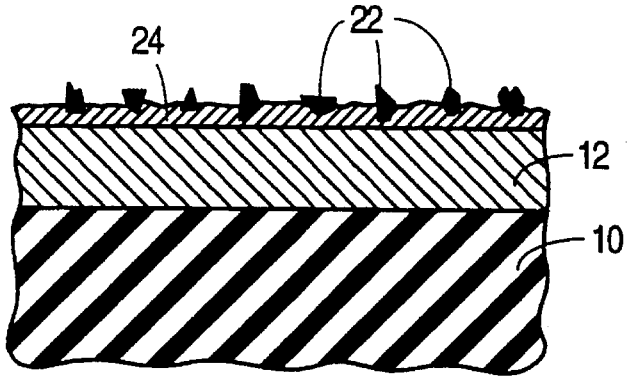

A heating step is performed to bond coated particles 22/34 securely to non-insulating region 12. Electrically non-insulating bonding material 24 forms during the heating step. See FIG. 5*c*. Bonding material 24 is typically created from at least part of particle coatings 34. The top surfaces of carbon-containing core particles 22 are exposed either during the heating step or in a separate operation performed after the heating step. When done separately, the exposure step can be performed by subjecting coated particles 22/34 to a solvent vapor. Alternatively, an etchant can be employed. For example, when particles 22 substantially consist of diamond grit, a pyrolysis can be done by heating the structure in an oxygen environment to remove the hydrogen in coatings 34, thereby leaving non-diamond carbon behind. Argon ion milling or a reactive-ion etch can then be utilized to remove the carbon. The final structure of FIG. 5*c* is suitable for the area emitter of FIG. 1.

Figure 6A:
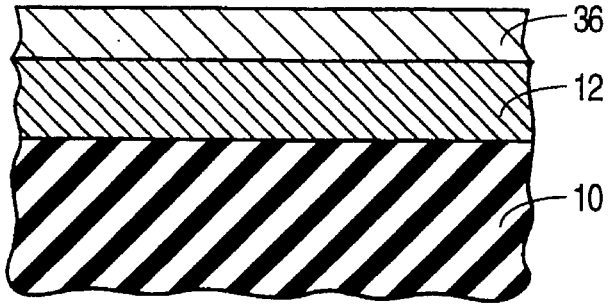
FIGS. 6*a*, 6*b*, and 6*c* are cross-sectional front views representing steps in part of an inventive process for fabricating the electron-emitting structure of FIG. 2.
Figure 6B:
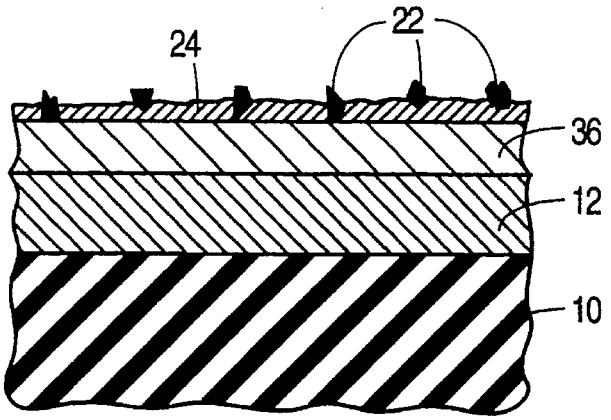
Figure 6C:
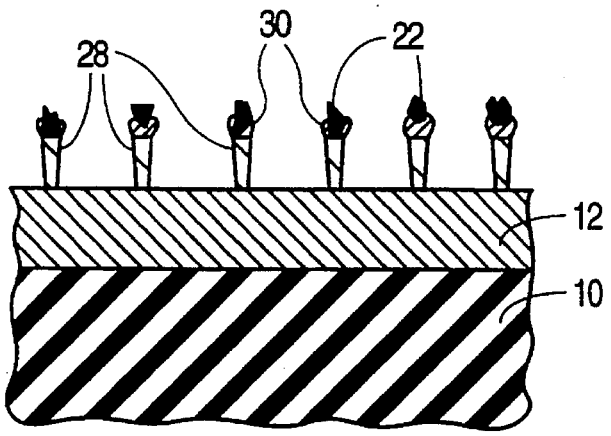

FIGS. 6*a*, 6*b*, and 6*c* (collectively "FIG. 6") illustrate a process for manufacturing part of the electron-emitting device of FIG. 2. As depicted in FIG. 6*a*, a lower electrically non-insulating region consisting of flat main portion 12 and an overlying flat further portion 36 is formed on insulating substrate 10. Part of further portion 36 of the lower non-insulating region later becomes further non-insulating layer 26 in FIG. 2. Accordingly, further portion 36 has a thickness of 0.1–2 μm, typically 0.5 μm.

Although not shown in FIG. 6*a*, portions 12 and 36 of the lower non-insulating region typical bear substantially identical patterns at this point. In particular, each of portions 12 and 36 is in the shape of a group of lines. Each line in further portion 36 overlies a corresponding line in main portion 12.

Main portion 12 typically consists of one of the materials described above for lower non-insulating region 12 in connection with FIGS. 1–3. Further portion 36 is typically formed with electrically non-insulating material different from that of main portion 12. Specifically, further portion 36 is selectively etchable with respect to main portion 12. When portion 12 consists of chromium, portion 36 is aluminum, titanium, molybdenum, or/and silicon. The structure in FIG. 6*a* is created by providing substrate 10 with a blanket layer of the material that constitutes portion 12, providing portion 12 with a blanket layer of the material that constitutes portion 36, and then performing a masked etch on the two blanket layers to created the desired pattern.

Alternatively, further portion 36 can be compositionally the same as main portion 12. If so, the line that runs between portions 12 and 36 in FIG. 6*a* is an imaginary line. In this case, the structure in FIG. 6*a* is created by depositing a blanket layer of a suitable electrical conductor on substrate 10 and then patterning the blanket conductive layer.

A multiplicity of electron-emissive particles 22 are distributed in a relatively uniform manner across the upper surface of non-insulating portion 36 in such a way that particles 22 are electrically coupled to, and securely fixed to, portion 36. See FIG. 6*b*. Particles 22 preferably consist of at least 50 atomic percent carbon in the form of electrically non-insulating diamond, graphite, amorphous carbon, or/and electrically non-insulating silicon carbide.

The step of distributing particles 22 across portion 36 can be performed in any of the ways described above in connection with the process variations shown in FIG. 4. Electrically non-insulating bonding material 24 that extends at least partially under particles 22 is created during the distributing step.

The portions (if any) of bonding material 24 situated to the sides of electron-emissive particles 22 are removed. The material of non-insulating portion 36 not covered (or not shadowed) by particles 22 is then removed. FIG. 6*c* shows the resulting structure in which electrically non-insulating pedestals 28 are the remaining parts of portion 36.

Items 30 in FIG. 6*c* indicate the small pieces of bonding material 24 that remain at the end of the removal step. Each electron-emissive particle 22 and underlying pedestal 28 (in combination with intervening bonding piece 30) form an electron-emissive pillar as noted above.

The removal step is typically done in one operation by anisotropically etching the structure starting from the upper structural surface. The anisotropic etch is performed in a direction largely perpendicular to the upper surface of portion 36 of the lower non-insulating region. Electron-emissive particles 22 act as etch masks for protecting the underlying parts of portion 36. Due to the nature of the anisotropic etch process, the mean diameter of each pedestal 28 normally decreases in going downward, and reaches a minimum value at or just slightly above the upper surface of main non-insulating portion 12.

When portions 12 and 36 of the lower non-insulating region consist of different materials, the anisotropic etch is typically done with an etchant that attacks portion 36 much more than portion 12. The etch is performed until substantially all the unprotected material of portion 36 is removed, using portion 12 as an etch stop to prevent further etching. Alternatively, the etch can be conducted for a time necessary to remove a metal thickness equal to that of portion 36. A timed etch is utilized when portions 12 and 36 consist of the same material.

When non-insulating portion 36 is formed with aluminum, molybdenum, or/and silicon, the anisotropic etch is done according to an ion-beam technique using chlorine, or according to a reactive-ion-etch procedure using fluorine. Any damage to particles 22, such as amorphization or unwanted graphitization, is removed by etching with a hydrogen plasma.

Alternatively, the removal operation to create pedestals 28 can be performed by milling the structure starting from the upper structural surface. As in the anisotropic-etch case, the milling is conducted in a direction largely perpendicular to the upper surface of non-insulating portion 36 using particles 22 as etch masks to protect the underlying parts of portion 36. The milling agent can consist of ions or other particles that do not significantly attack particles 22. For example, argon ions are suitable for milling portion 36 when it consists of gold. When milling is employed, the mean diameter of each pedestal 28 is largely constant along its full length.

Figure 7A:
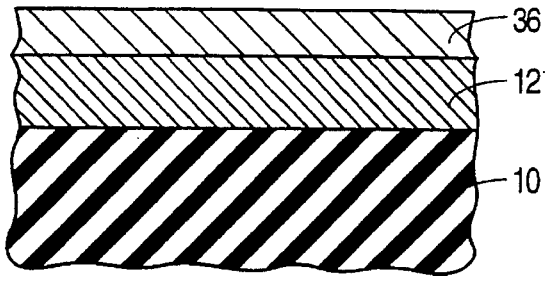
FIGS. 7*a*, 7*b*, 7*c*, and 7*d* are cross-sectional front views representing steps in part of an alternative inventive process for fabricating the electron-emitting structure of FIG. 2.

FIGS. 7*a*, 7*b*, 7*c*, and 7*d* (collectively "FIG. 7") depict another procedure for manufacturing part of the electron-emitting device of FIG. 2. As shown in FIG. 7*a*, a lower electrically non-insulating region consisting of patterned main portion 12 and like-patterned further portion 36 is again formed on insulating substrate 10. Portions 12 and 36 of the lower non-insulating region in FIG. 7*a* typically have the same properties, and are formed in the same manner, as described above for the process of FIG. 6.

Electron-emissive particles 22, are provided with polymeric outer coatings 34 in the manner specified above for the process of FIG. 5. Particles 22 again preferably contain at least 50 atomic percent carbon in the form of electrically non-insulating diamond, graphite, amorphous carbon, or/and electrically non-insulating silicon carbide. More preferably, particles 22 are diamond grit.

Figure 7B:
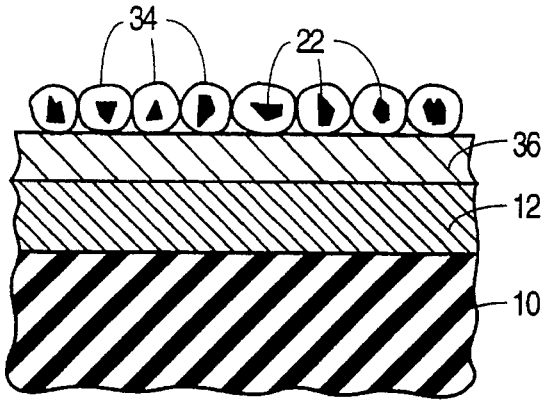
Figure 7C:
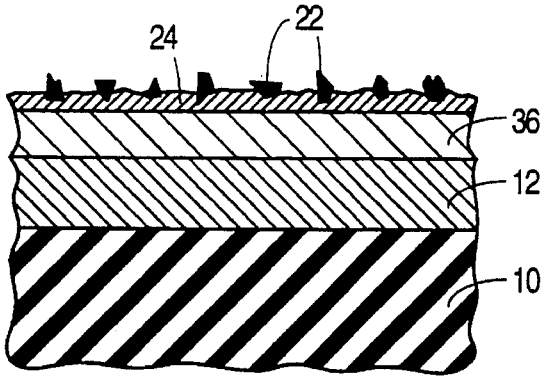

Using any of the procedures described above for the process of FIG. 5, a multiplicity of coated particles 22/34 are dispersed uniformly across the top of non-insulating portion 36 as illustrated in FIG. 7*b*. The structure is then heated and, as necessary, etched in the manner specified above for the process of FIG. 6 in order to securely fix core particles 22 to portion 36 and to expose their upper surfaces. FIG. 7*c* shows the resultant structure in which item 24 is the electrically non-insulating particle bonding material produced during the heating step for bonding particles 22 to portion 36.

Figure 7D:
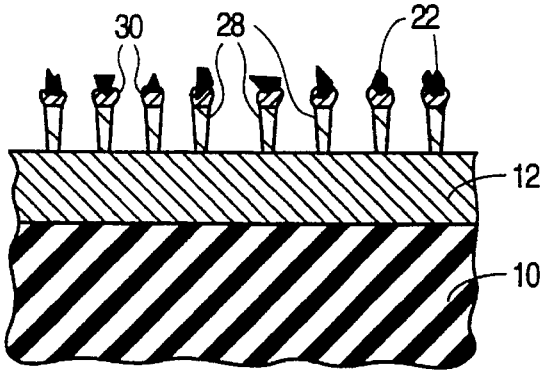

An operation is performed to remove the portions (if any) of bonding material 24 situated to the sides of particles 22 and then to remove the material of non-insulating portion 36 not covered by particles 22. The removal operation is typically performed by anisotropically etching or milling in the same way as in the process of FIG. 6. The resultant structure, as depicted in FIG. 7*d*, is largely the same as the structure of FIG. 6*c*.

Pedestals 28 again are the remaining parts of portion 36 of the lower non-insulating region. Likewise, items 30 are the small remaining pieces of bonding material 24. Each pedestal 28 and overlying particle 22 (in combination with intervening bonding piece 30) again form an electron-emissive pillar.

The processes of FIGS. 4–7 can be altered in a number of ways. Prior to forming particle bonding material 24, additional particles (not shown) can be dispersed among carbon-containing particles 22. The presence of the additional particles causes the spacing among particles 22 in the final electron-emitting devices of FIGS. 1 and 2 to be increased in a relatively uniform manner.

When the electron-emitting devices are operated in field-emission mode, the increased spacing among particles 22 reduces the electric-field screening that particles 22 otherwise impose on one another. This increases the local electric field to which particles 22 are subjected. As a result, the electron-emission current density is typically increased.

The additional particles are differently constituted than carbon-containing particles 22 and may or may not be present in the final electron emitters of the invention. In particular, the outer surfaces of the additional particles can be electron-emissive or non-emissive of electrons. If the additional particles are electron-emissive, they are not present in the final electron emitters. If non-emissive, the additional particles can be present in the final electron emitter of FIG. 1 depending on the processing technique used, but normally are not present in the pillared final electron-emitting device of FIG. 2. Aside from not being shown in FIGS. 4–7, the additional particles, when present, do not appear in FIG. 1 (or 2).

Fabrication of an electron emitter using additional particles to increase the spacing among carbon-containing particles 22 typically entails mixing the additional particles either with uncoated particles 22 (processes of FIGS. 4 and 6) or with coated particles 22/34 (processes of FIGS. 5 and 7). The mixture of particles is then dispersed over lower non-insulating region 12 or 12/36 using one of the techniques described above for particles 22. This includes dispersing particles 22 and the additional particles across region 12, layer 32, or portion 36 in the processes of FIGS. 4 and 6 as well as dispersing particles 22/34 and the additional particles across region 12 or 12/36 in the processes of FIGS. 5 and 7.

Particles 22 are then securely bonded to non-insulating region 12 or 12/36 utilizing a suitable bonding technique such as one of those described above. If the additional particles are electron-emissive or if the pillared structure of FIG. 2 is being produced, the additional particles are removed either as part of the bonding operation or during a separate removal step (e.g., an etch) which does not significantly affect particles 22. When the additional particles are non-emissive and the structure of FIG. 1 is being produced, the additional particles can be left in place or removed during or after the bonding operation. If left in place, the additional particles consist of material having a low dielectric constant.

Instead of utilizing carbon-containing particles which are electron emissive in their natural state or have been made electron emissive prior to dispersing the particles across lower non-insulating region 12 or 12/36, electron-emissive particles 22 can be replaced with carbon-containing particles that are made electron emissive after being dispersed over region 12 or 12/36. These carbon-containing particles would typically be formed with diamond or/and silicon carbide.

In these process alterations, any of the techniques described above for making carbon-containing particles electron emissive prior to the particle-dispersion step can be employed after the dispersion step to modify the carbon-containing particles in order to make them electron emissive. This includes laser annealing. The carbon-containing particles in these variations still consist of at least 50 atomic percent carbon. Likewise, each of the particles has an average mean diameter of 5 nm–1 μm.

Electron-emissive particles having less than 50 atomic percent carbon could be substituted for carbon-containing particles 22 in the processes of FIGS. 5–7 and thus also in the electron-emitting structure of FIG. 2. In fact, the atomic percent of carbon in the substituted particles could be substantially zero. For example, electron-emissive particles formed with molybdenum and coated with a polymer could be substituted for carbon-containing particles 22 in the processes of FIGS. 5 and 7. Electron-emissive particles formed with nickel could be substituted for carbon-containing particles 22 in the process of FIG. 6. If the material used to make the substitute particles is not naturally electron emissive, the particles can be modified before or after the particle-dispersion step to make them electron emissive.

Particles 22 or any of the replacement/substitute particles described above can also be treated with cesium or another alkali metal to improve their electron-emission characteristics. The electron emissivity of particles 22 can be augmented by treating them with electronegative matter and electropositive metal in the manner described in Geis et al, U.S. patent application Ser. No. 8/090,228, filed 9Jul. 1993, U.S. Pat. No. 5,463,271.

The process sequences of FIGS. 4–7, including the above-described process alterations, can be utilized in various ways to create the area electron-emitting devices of FIGS. 1 and 2 in which patterned structural layer 14 is also present. For example, in one overall process for manufacturing the area emitters of both FIGS. 1 and 2, a blanket layer of electrically non-insulating material suitable for lower non-insulating region 12 or 12/36 is deposited on insulating substrate 10. The blanket conductive layer is photolithographically etched using an appropriate photoresist mask to form region 12 or 12/36.

Next, a blanket layer of dielectric material suitable for dielectric layer 16 is deposited on non-insulating region 12 or 12/36. A blanket layer of electrically non-insulating material suitable for gate layer 18 is deposited on the dielectric blanket layer. Open spaces 20 are then formed through the two blanket layers. If open spaces 20 have a mean diameter of 2 μm or more, spaces 20 are preferably created by a photolithographic etching technique using an appropriate photoresist mask. If the mean diameter of open spaces 20 is 1 μm or less, spaces 20 are preferably created by etching along charged-particle tracks as described in Spindt et al, co-filed U.S. patent application Ser. No. 08/269,229, "Use of Charged-Particle Tracks in Fabricating Gated Electron-Emitting Devices," filed 29Jun. 1994, now U.S. Pat. No. 5,564,959.

Instead of depositing the dielectric blanket layer on region 12 or 12/36, depositing the non-insulating blanket layer on the dielectric blanket layer, and then forming open spaces 20, the two blanket layers could be fabricated as a separate unit which is mounted on region 12 or 12/36 before or after forming open spaces 20 through the unit. Carbon-containing particles 22 or the various replacement/substitute particles described above are subsequently distributed over region 12 or 12/36 in open spaces 20 according to one of the above-described techniques. As desired, this includes utilizing additional particles to increase the spacing among the electron-emissive particles in the manner described above. This also includes forming pedestals 28 in the area emitter of FIG. 2.

Another overall process for manufacturing the area emitter of FIG. 1 (but typically not the area emitter of FIG. 2) begins in the same way as the overall manufacturing process described in the foregoing three paragraphs. A blanket layer of electrically non-insulating material suitable for lower non-insulating region 12 is deposited on insulating substrate 10 after which the blanket non-insulating layer is photolithographically etched to create region 12. At this point, the second overall process diverges from the first overall process.

In particular, one of the above-described techniques is employed to distribute carbon-containing particles 22 or the various replacement/substitute particles across non-insulating region 12 before dielectric layer 16 is formed over region 12. As desired, this likewise includes utilizing additional particles which increase the spacing among the electron-emissive particles.

A blanket layer of dielectric material suitable for dielectric layer 16 is deposited on the upper surface of the structure. A blanket layer of electrically non-insulating material suitable for gate layer 18 is deposited on the blanket dielectric layer. Open spaces 20 are then formed through the two blanket layers using either the photolithographic-etching technique or the track-etching technique described above for the first-mentioned overall manufacturing process. In so doing, either carbon-containing particles 22 or the various replacements/substitute particles are exposed. Alternatively, the two blanket layers that become layers 16 and 18 could be formed as a separate unit which is mounted on top of the structure before or after forming open spaces 20 through the unit.

By using an overall fabrication process in which electron-emissive particles are distributed across the upper surface of non-insulating region 12 before dielectric layer 16 is provided over region 12, some of the particles end up being situated along the interface between region 12 and layer 16. In this regard, the vertical dimensions of particles 22 have, for purposes of illustration, been greatly exaggerated in FIG. 1 compared to thicknesses of layers 16 and 18. For example, the thickness of layer 16 is typically ten times the average height of particles 22 in FIG. 1. The net result is that the presence of electron-emissive particles along the interface between region 12 and layer 16 does not significantly affect device manufacture or performance.

The electron-emitting devices of the present invention are typically operated in field-emission mode. An anode (or collector) structure is situated a short distance away from the electron-emission areas. The anode is maintained at a positive voltage relative to non-insulating region 12. When a suitable voltage is applied between (a) a selected one of the emitter-electrode lines that form region 12 and (b) a selected one of the gate-electrode lines that form gate layer 18, the selected gate-electrode line extracts electrons from the electron-emissive areas at the intersection of the two selected lines and controls the magnitude of the resulting electron current. Desired levels of electron emission typically occur when the applied gate-to-cathode parallel-plate electric field reaches 20 volts/μm or less at a current density of 0.1 $mA/cm^2$ as measured at the phosphor-coated faceplate in a flat-panel CRT display. The extracted electrons are subsequently collected at the anode.

Directional terms such as "lower" and "down" have been employed in describing the present invention to establish a frame of reference by which the reader can more easily understand how the various parts of the invention fit together. In actual practice, the components of an electron-emitting device may be situated at orientations different from that implied by the directional terms used here. The same applies to the way in which the fabrication steps are performed in the invention. Inasmuch as directional terms are used for convenience to facilitate the description, the invention encompasses implementations in which the orientations differ from those strictly covered by the directional terms employed here.

While the invention has been described with reference to particular embodiments, this description is solely for the purpose of illustration and is not to be construed as limiting the scope of the invention claimed below. For example, in some embodiments, particle bonding material 24 may be electron emissive. Even if the tops of electron-emissive particles 22 are partially covered by bonding material 24, the emissivity of material 24 may be sufficient to achieve an electron current density of 0.1 $mA/cm^2$ as measured at the phosphor-coated faceplate at an applied gate-to-cathode parallel-plate electric field of 20 volts/μm.

Substrate 10 could be deleted if lower non-insulating region 12 is a continuous layer of sufficient thickness to support the structure. Insulating substrate 10 could be replaced with a composite substrate in which a thin insulating layer overlies a relatively thick non-insulating layer that furnishes the necessary structural support. Lower region 12 could be patterned in configurations other than parallel lines.

Gate layer 18 could be employed to modulate the movement of electrons extracted from electron-emissive particles 22 by the anode. The area emitters of FIGS. 1 and 2 could be utilized with different gate-electrode configurations than described above. In fact, the area emitter of FIG. 2 could be utilized as a diode—i.e., without a gate electrode.

Coated particles 22/34 could be dispersed across the upper surface of non-insulating region 12 in less than a monolayer without using additional particles to increase the spacing of particles 22/34. Various modifications and applications may thus be made by those skilled in the art without departing from the true scope and spirit of the invention as defined in the appended claims.

We claim:

1. An electron-emitting device comprising:

a lower electrically non-insulating region;

a multiplicity of laterally separated electron-emissive carbon-containing particles distributed over, and electrically coupled to, the lower non-insulating region, the carbon in each carbon-containing particle being in the form of at least one of electrically non-insulating diamond, graphite, and amorphous carbon, electron emission from each carbon-containing particle occurring principally at carbon regions in the form of at least one of graphite and amorphous carbon; and electrically non-insulating particle bonding material that securely bonds the carbon-containing particles to the lower non-insulating region.

2. A device as in claim 1 wherein each carbon-containing particle consists of at least 50 atomic percent carbon.

3. A device as in claim 1 wherein the carbon-containing particles have an average mean diameter of 5 nm–1 μm.

4. A device as in claim 1 wherein the bonding material comprises electrically non-insulating carbide.

5. A device as in claim 1 further including a structural layer situated over the lower non-insulating region, an open space extending through the structural layer to expose at least part of the carbon-containing particles.

6. A device as in claim 5 wherein the structural layer comprises:

a dielectric layer situated over the lower non-insulating region; and an electrically non-insulating gate layer situated over the dielectric layer.

7. A device as in claim 5 wherein the lower non-insulating region is a patterned layer comprising a group of generally parallel lines.

8. A device as in claim 1 wherein the device is operable in field-emission mode.

9. A device as in claim 1 wherein the carbon-containing particles are situated at locations substantially random relative to one another.

10. A device as in claim 1 further including a substrate situated below the lower non-insulating region.

11. An electron-emitting device comprising:

a lower electrically non-insulating region; and a multiplicity of laterally separated electron-emissive carbon-containing particles distributed over, and electrically coupled to, the lower non-insulating region, the carbon in each carbon-containing particle being principally in the form of at least one of graphite and amorphous carbon.

12. A device as in claim 11 wherein each carbon-containing particle consists of at least 50 atomic percent carbon.

13. A device as in claim 11 wherein electron emission from each particle occurs principally at graphitic regions.

14. An electron-emitting device comprising:

a lower electrically non-insulating region; and a multiplicity of laterally separated electron-emissive pillars situated over the lower non-insulating region, each pillar comprising (a) an electrically non-insulating pedestal electrically coupled to the lower non-insulating region, the side surface of the pedestal extending generally vertically or sloping inward along at least part of the pedestal's height in going downward, and (b) an electron-emissive particle situated over the pedestal along its upper surface.

15. A device as in claim 14 wherein the electron-emissive pillars are situated at locations substantially random relative to one another.

16. A device as in claim 15 wherein each electron-emissive particle contains carbon principally in the form of at least one of electrically non-insulating diamond, graphite, and amorphous carbon.

17. A device as in claim 15 wherein each electron-emissive particle consists of at least 50 atomic percent carbon.

18. A device as in claim 15 further including electrically non-insulating particle bonding material that securely bonds each electron-emissive particle to the corresponding pedestal.

19. A device as in claim 15 wherein the mean top diameter of each pedestal is approximately the same as the mean lateral diameter of the corresponding electron-emissive particle.

20. A device as in claim 15 wherein the ratio of the height of each pedestal to its maximum diameter averages at least 1.

21. A device as in claim 15 further including a structural layer situated on the lower non-insulating region, the pillars being located in an open space that extends through the structural layer down to the lower non-insulating region.

22. A device as in claim 21 wherein the structural layer comprises:

a dielectric layer situated over the lower non-insulating region; and an electrically non-insulating gate layer situated over the dielectric layer.

23. A device as in claim 22 wherein the structural layer includes a further electrically non-insulating layer situated between the lower non-insulating region and the dielectric layer.

24. A device as in claim 15 further including a substrate situated below the lower non-insulating region.

25. A device as in claim 15 wherein the ratio of the height of each pedestal to its mean diameter is at least 1.

26. A device as in claim 25 wherein the ratio of the height of each pedestal to its mean diameter is no more than 20.

27. A device as in claim 15 wherein each electron-emissive particle consists primarily of electrically non-insulating diamond.

28. An electron-emitting device comprising:

a lower electrically non-insulating region;

a multiplicity of laterally separated electron-emissive carbon-containing particles distributed over, and electrically coupled to, the lower non-insulating region, the carbon in each carbon-containing particle being in the form of at least one of electrically non-insulating diamond, graphite, and amorphous carbon, electron emission from each carbon-containing particle occurring principally at graphitic regions; and electrically non-insulating particle bonding material that securely bonds the carbon-containing particles to the lower non-insulating region.

29. An electron-emitting device comprising:

a lower electrically non-insulating region;

a multiplicity of laterally separated electron-emissive diamond-containing particles distributed over, and electrically coupled to, the lower non-insulating region, electron emission from each diamond-containing particle occurring principally at graphitic regions; and electrically non-insulating particle bonding material that securely bonds the diamond-containing particles to the lower non-insulating region.

30. A device as in claim 29 wherein each diamond-containing particle consists primarily of electrically non-insulating diamond.

31. A device as in claim 29 wherein the diamond-containing particles comprise diamond grit.

32. A device as in claim 29 wherein the bonding material comprises electrically non-insulating carbide.

33. A device as in claim 29 further including a structural layer situated over the lower non-insulating region, an open space extending through the structural layer to expose at least part of the diamond-containing particles.

34. A device as in claim 33 wherein the structural layer comprises:

a dielectric layer situated over the lower non-insulating region; and an electrically non-insulating gate layer situated over the dielectric layer.

35. A device as in claim 29 wherein the diamond-containing particles are situated at locations substantially random relative to one another.

* * * * *

UNITED STATES PATENT AND TRADEMARK OFFICE

CERTIFICATE OF CORRECTION

PATENT NO. : 5,608,283
DATED : March 4, 1997
INVENTOR(S) : Twichell et al

It is certified that error appears in the above-identified patent and that said Letters Patent is hereby corrected as shown below:

On the cover page, the assignee information should read --Assignees: Candescent Technologies Corporation, San Jose, Calif.; Massachusetts Institute of Technology, Cambridge, Mass.; Advanced Technology Materials, Inc., Danbury, Conn.--.

Signed and Sealed this

Twentieth Day of May, 1997

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,608,283
DATED : March 4, 1997
INVENTOR(S) : Twitchell et al.

It is certified that error appears in the above-identified patent and that said Letters Patent is hereby corrected as shown below:

Column 1,
Please delete the paragraph pertaining to the Government Support and replace with the insertion of the following text:

-- GOVERNMENT RIGHTS IN INVENTION

This invention was made with the support of the U.S. Government under Contract No. F19628-90-C-0002 awarded by the Air Force and under contract No. N00014-93-C-0264 awarded by the Office of Naval Research. The Government has certain rights in this invention. --

Signed and Sealed this

Twenty-third Day of April, 2002

*Attest:*

*Attesting Officer*

JAMES E. ROGAN
*Director of the United States Patent and Trademark Office*